US010900392B2

(12) United States Patent
Feng et al.

(10) Patent No.: US 10,900,392 B2
(45) Date of Patent: Jan. 26, 2021

(54) INVERTED NON-STOP LIFEBOAT DIESEL ENGINE LUBRICATION SYSTEM AND FLOW CONFIGURATION METHOD THEREOF

(71) Applicant: JIANGSU UNIVERSITY OF SCIENCE AND TECHNOLOGY, Jiangsu (CN)

(72) Inventors: Xuedong Feng, Jiangsu (CN); Youlin Ling, Jiangsu (CN); Jian Zhang, Jiangsu (CN); Wenxian Tang, Jiangsu (CN); Anlong Sun, Jiangsu (CN); Xujin Huang, Jiangsu (CN); Zhongchen Liang, Jiangsu (CN); Wei Zang, Jiangsu (CN); Qiang Li, Jiangsu (CN); Tong Chen, Jiangsu (CN); Jun Shi, Jiangsu (CN); Dongsheng Liang, Jiangsu (CN); Ping Hu, Jiangsu (CN); Yongjun Feng, Jiangsu (CN); Cheng Chen, Jiangsu (CN)

(73) Assignee: JIANGSU UNIVERSITY OF SCIENCE AND TECHNOLOGY, Jiangsu (CN)

( * ) Notice: Subject to any disclaimer, the term of this patent is extended or adjusted under 35 U.S.C. 154(b) by 0 days.

(21) Appl. No.: 16/603,834

(22) PCT Filed: Dec. 1, 2017

(86) PCT No.: PCT/CN2017/114183
§ 371 (c)(1),
(2) Date: Oct. 9, 2019

(87) PCT Pub. No.: WO2018/223627
PCT Pub. Date: Dec. 13, 2018

(65) Prior Publication Data

US 2020/0049035 A1 Feb. 13, 2020

(30) Foreign Application Priority Data

Jun. 7, 2017 (CN) ..... 2017 1 0421424

(51) Int. Cl.
*F01M 1/02* (2006.01)
*F01M 1/10* (2006.01)
(Continued)

(52) U.S. Cl.
CPC ..... *F01M 1/02* (2013.01); *F01M 1/10* (2013.01); *F01M 1/16* (2013.01); *F01M 11/0004* (2013.01);
(Continued)

(58) Field of Classification Search
CPC ..... F01M 1/02; F01M 13/04; F01M 11/0004; F01M 2001/123; F01M 2011/0079
See application file for complete search history.

(56) References Cited

U.S. PATENT DOCUMENTS 4,373,421 A * 2/1983 Camboulives ..... F16N 7/32 184/6.12
8,215,292 B2 * 7/2012 Bryant ..... F02B 33/06 123/559.1
2008/0132129 A1 * 6/2008 Miyata ..... F01M 11/0004 440/88 L

FOREIGN PATENT DOCUMENTS

CN 101392670 3/2009
CN 201763409 3/2011
(Continued)

OTHER PUBLICATIONS

"International Search Report (Form PCT/ISA/210) of PCT/CN2017/114183," dated Mar. 1, 2018, with English translation thereof, pp. 1-4.

*Primary Examiner* — S. Joseph Morano
*Assistant Examiner* — Jovon E Hayes
(74) *Attorney, Agent, or Firm* — JCIPRNET

(57) ABSTRACT

A lubrication system includes an engine oil pump, a lubricating oil tank, a breathing pipe, a machine body, and an oil pan. The engine oil pump is formed by superposing upper and lower layers being a lubricating pump and an oil return pump. An oil inlet of the oil return pump leads to a cavity
(Continued)

of the oil pan, and an oil outlet leads to an interior of the lubricating oil tank. An oil inlet of the lubricating pump leads to the interior of the lubricating oil tank, and an oil outlet leads to a machine filter. The machine filter is communicated with a main oil path of the machine body. An oil tank cover of the lubricating oil tank is provided with a breathing one-way valve and an oil filling port. The breathing one-way valve communicates one end of the breathing pipe, and the other end thereof communicates a crankcase.

9 Claims, 3 Drawing Sheets

(51) Int. Cl.
*F01M 1/16* (2006.01)
*F01M 11/00* (2006.01)
*F01M 13/00* (2006.01)

(52) U.S. Cl.
CPC . *F01M 13/0011* (2013.01); *F01M 2001/1078* (2013.01); *F01M 2001/1092* (2013.01)

(56) References Cited

FOREIGN PATENT DOCUMENTS

| | | | | | |
|---|---|---|---|---|---|
| CN | 103925042 | | | 7/2014 | |
| CN | 107143395 | A | * | 9/2017 | ..... F01M 1/02 |
| CN | 107246296 | | | 10/2017 | |
| CN | 107355280 | A | * | 11/2017 | ..... F01M 1/02 |

* cited by examiner

INVERTED NON-STOP LIFEBOAT DIESEL ENGINE LUBRICATION SYSTEM AND FLOW CONFIGURATION METHOD THEREOF

CROSS-REFERENCE TO RELATED APPLICATION

This application is a 371 of international application of PCT application serial no. PCT/CN2017/114183, filed on Dec. 1, 2017, which claims priority to and the benefit of China Patent Application No. 201710421424.9, filed on Jun. 7, 2017. The entirety of each of the above-mentioned patent applications is hereby incorporated by reference herein and made a part of this specification.

BACKGROUND

Technical Field

The present invention relates to a diesel engine lubrication system and a flow configuration method thereof, and in particular, to an inverted non-stop lifeboat diesel engine lubrication system and a flow configuration method thereof, which achieve non-stop free-fall of a lifeboat into water from a free-fall holder of a mother ship under the working state of a diesel engine, and belong to the technical field of marine diesel engines.

Description of Related Art

A lifeboat falls freely from a mother ship, which can greatly improve the efficiency of lifesaving. The technology is increasingly being valued and used by people. However, a selected lifeboat main engine is an inverted stop diesel engine. That is, the diesel engine starts to ignite after the lifeboat enters water and is straightened automatically, which wastes some valuable lifesaving time. Therefore, the quick performance of a free-fall lifeboat is also restricted.

At present, according to an inverted non-stop lifeboat diesel engine lubrication system, when a lifeboat is turned over and inverted, there is not only a problem that a diesel engine can only be turned over around an axis parallel to a crankshaft axis, that is, the lifeboat can only be turned over transversely, but also a problem of engine oil leakage when the diesel engine is turned over and inverted. Although the diesel engine complies with the revised Recommendation on Lifesaving Equipment Testing, passed by the International Maritime Organization's International Convention for the Safety of Life at Sea (SOLAS) 2009 and the International Maritime Organization's Maritime Safety Committee MSC.81 (70). "Engine Inversion Test 6.14.6: An engine is fixed to a holder that is rotatable about an axis equivalent to a longitudinal axis of a lifeboat, and a plate is provided under the engine to collect leaking oil for measurement. 6.14.7: The test proceeds according to the following steps: . . . 6.14.7.8: The running engine is rotated clockwise for 180°, held at 180° for 10 s, and then rotated clockwise for 180° to complete a turn (comprehensive test step, in which a diesel engine needs to complete the clockwise and counterclockwise rotation for a total of 6 turns during one test). 6.14.8: During the test, the engine should not undergo overheat, work failure, or leakage of oil of over 250 ml when being inverted at any time." However, the requirements for free-fall of a lifeboat diesel engine into water from a mother ship davit under a non-stop state and longitudinal turnover caused by sea wave rolling of the lifeboat during the driving process cannot be met.

It is well known that the condition for ensuring short-time working of the diesel engine under a turnover and inverted state is to provide good lubrication for the diesel engine. The existing lifeboat diesel engine has an inverted non-stop device, such as patent No. 200810154941.5. The device is provided with a main breather mounted on a cylinder head casing and a secondary breather mounted on an advancer cover. The main breather is used for the upright working of a diesel engine, and the secondary breather is used for the inverted working of the diesel engine. In addition, the main structure of the device further includes a partition board between a crankcase and a cavity of an oil pan to seal the crankcase from the cavity of the oil pan. A one-way valve is provided on the partition board. When the diesel engine is upright or a heel is less than or equal to 90°, the one-way valve is in an on state, the crankcase is communicated with the cavity of the oil pan for convenience of oil return of the diesel engine. When the heel of the diesel engine is more than 90°, a valve port of the one-way valve is automatically closed, and the crankcase is separated from the cavity of the oil pan, so as to control engine oil in the cavity of the oil pan to flow into the crankcase, thereby always immersing an engine oil pump oil suction port into the engine oil in the cavity of the oil pan when the diesel engine is turned over and inverted, and keeping the diesel engine lubricated.

The free-fall lifeboat is fixed to a free-fall holder of a mother ship with a boat bow facing down at an angle of inclination of 35°-45° between a longitudinal direction of the boat and a horizontal plane. The diesel engine of the lifeboat is fixed to the bottom of a lifeboat cabin with a gear chamber end facing the boat bow and a flywheel end facing a boat stern. When the lifeboat falls freely, the lifeboat straightly falls into water with the boat bow facing down, the diesel engine is turned over longitudinally for about 90° accordingly, and the gear chamber faces down. Therefore, the existing inverted non-stop lifeboat diesel engine is mounted into the free-fall lifeboat, and then the lifeboat is fixed to the free-fall holder of the mother ship. The one-way valve on the partition board of the oil pan has not been cut off, that is, the oil pan and the crankcase of the diesel engine are communicated. Therefore, a part of engine oil in the cavity of the oil pan of the diesel engine will flow into the crankcase and the gear chamber through the valve port of the one-way valve, causing the oil level in the cavity of the oil pan to drop, so that the remaining engine oil in the cavity of the oil pan cannot maintain the lubrication of the whole free-fall process of the diesel engine. In addition, at present, when the diesel engine is working, only the engine oil pressure of the lubrication system is controlled, and the flow is not controlled. Usually, the lubricating pump is designed with sufficient margin. Therefore, when the diesel engine is working, the overflow valve will generate a large amount of oil spill, which will increase the oil temperature. Also, the oil consumption will increase when the diesel engine is turned over and inverted. The oil storage capacity of the cavity of the oil pan increases, which makes the oil level of the diesel engine rise after the free-fall holder is fixed and the engine oil immerses a secondary breather port of the diesel engine, so that the engine oil flows out of the machine from the secondary breather port, thereby causing engine oil waste and environmental pollution.

In addition, when the diesel engine falls down, the engine oil of the diesel engine that flows from the cavity of the oil pan into the crankcase and a gear chamber cover originally in a fixed state will immerse the secondary breather port of the diesel engine, thereby causing uncontrolled leakage of the engine oil of the diesel engine. Therefore, the structure cannot meet the requirements for use of a free-fall inverted non-stop lifeboat diesel engine.

In addition, because an outer space of the oil pan of the diesel engine in the lifeboat is extremely narrow, the engine oil is usually pumped from the cavity of the oil pan using an oil dipstick tube during the replacement of the engine oil of the diesel engine, which is not only low in efficiency, but also difficult to completely pump the engine oil in the cavity of the oil pan.

Based on the above, for a current lifeboat diesel engine inverted non-stop device, in order to achieve non-stop free-fall of a lifeboat into water from a free-fall holder of a mother ship under a working state of a diesel engine, it is necessary to solve the following problems: 1, the diesel engine cannot be turned over longitudinally; 2, engine oil leaks out when the diesel engine is turned over; and 3, the flow of lubricating oil of the diesel engine cannot be reasonably configured.

SUMMARY

The object of the present invention is to overcome the existing inverted non-stop lifeboat diesel lubrication system and the flow configuration method thereof, which can only be reversed laterally, cannot be vertically reversed, and engine oil leakage pollution occurs when the diesel engine is turned over; and the lubricating oil flow of the diesel engine cannot be reasonably configured. The flow valve overflows too much oil, causing waste of resources.

The present invention provides an inverted non-stop lifeboat diesel engine lubrication system and a flow configuration method thereof, which meet the requirements for free-fall of a lifeboat diesel engine into water from a free-fall holder of a mother ship under a non-stop state and longitudinal and transverse turnover and inversion caused by sea wave rolling of the lifeboat during the driving process.

In order to achieve the above object, the present invention is implemented by the following technical solutions.

An inverted non-stop lifeboat diesel engine lubrication system and a flow configuration method thereof are provided. The lubrication system includes an engine oil pump, an overflow valve, and a machine body. A crankcase is provided inside the machine body. An oil pan is provided at the bottom of the machine body. The lubrication system is characterized by further including a lubricating oil tank and a breathing pipe. The lubricating oil tank is provided beside a gear chamber of a diesel engine. Front and back surfaces of the lubricating oil tank are symmetric with a longitudinal vertical plane of a crankshaft axis of the diesel engine. A support is provided at the bottom of the lubricating oil tank. The engine oil pump is a double pump having oil inlets and outlets independent separately, which is formed by superposing upper and lower layers. The upper layer is a lubricating pump and a lower layer is an oil return pump. The oil inlet of the oil return pump is connected to the bottom of a cavity of the oil pan through a pipeline. The oil outlet is connected to the interior of the lubricating oil tank through a pipeline. The oil inlet of the lubricating pump is connected to the interior of the lubricating oil tank through a pipeline. The oil outlet is connected to an inlet of a machine filter through a pipeline. An inlet of the overflow valve is connected to a bypass between the oil outlet and the inlet of the machine filter. An outlet of the machine filter is communicated with a main oil path of the machine body. An outlet of the overflow valve is communicated with the crankcase. The lubricating oil tank includes an oil tank cover and an oil tank body. The oil tank cover is provided with a breathing one-way valve and an oil filling port. An inlet of the breathing one-way valve is provided below the oil tank cover. An outlet of the breathing one-way valve is provided above the oil tank cover. The outlet of the breathing one-way valve is communicated with one end of the breathing pipe. The other end of the breathing pipe is communicated with the crankcase. The oil filling port is provided with an oil filling port cover. The oil filling port cover is provided with an air pressure relief valve. An oil drain valve is provided at the bottom of the oil tank body. An oil level indicator is provided on the side of the oil tank body.

The object of the present invention may also be further achieved by the following technical solutions.

The engine oil pump is provided in the oil pan. An upper end of a pump shaft of the engine oil pump extends out of a pump body and penetrates through a bearing hole in the machine body. A worm gear is also provided at a top end of the pump shaft, and meshes with a worm provided on a camshaft of the diesel engine. An upper end of the pump body of the engine oil pump is provided with a flange fixed to the machine body.

Both the oil return pump and the lubricating pump are rotor pumps.

For the oil return pump and the lubricating pump, the lubricating pump is designed to have a theoretical flow of 23-24 liters/min at a rated speed of the diesel engine of 2,800 rpm, and the oil return pump is designed to have a theoretical flow greater than the flow of the lubricating pump by 1-1.5 liters/min.

The oil outlet of the oil return pump is connected to the interior of the lubricating oil tank through a pipeline. An oil return valve is provided between a pipeline tip of the oil outlet and the lubricating oil tank.

The oil inlet of the lubricating pump is connected to the interior of the lubricating oil tank through a pipeline. An oil inlet valve is provided between a pipeline tip of the oil inlet and the lubricating oil tank.

The oil level indicator is provided in the upper middle of a left side surface of the oil tank body, and is mounted vertically. The oil level indicator is provided with two oil level indicating sections at upper and lower ends. The oil level section at the upper end is a green mark. The oil level section at the lower end is a blue mark.

The worm gear has 13 teeth, the worm has 13 heads, and an end face modulus is 1.5.

The oil pan is a rectangular oil basin. The bottom of the basin inclines from left to right at an inclination angle $\alpha$ of 2°-3°. An oil collection groove is further provided in the bottom of a right end of the oil basin.

The oil return pump includes a long funnel-shaped oil suction port with a filter screen, which is provided on the lower right side of the oil collection groove. A large end of the long funnel-shaped oil suction port faces the bottom of the oil collection groove.

The lubricating pump is provided with a funnel-shaped oil suction port. A larger end of the funnel-shaped oil suction port is provided with a magnetic filter screen facing always downward. A smaller end of the funnel-shaped oil suction port is connected to a suction port oil pipe end of the oil inlet valve on the side of the lubricating oil tank by a flexible oil pipe.

In the lubricating oil tank, a sealing ring is provided between the oil tank body and the oil tank cover.

The lubricating oil tank is a rectangular parallelepiped having a capacity of 8-9 liters and is made of stainless steel.

The support has a height of not less than 200 mm.

The breathing one-way valve is disposed in the left middle of the oil tank cover.

The breathing one-way valve has a cylindrical casing with an inner wall and an outer wall that are both in shape of single step. An inner diameter and an outer diameter of the cylindrical casing are smaller at upper end than those at lower end. The upper end is an outlet of a breathing one-way valve. The lower end is an inlet of a breathing one-way valve. Both the inner and outer of the upper end are provided with thread.

An oil-way distribution block is provided between the machine body and the machine filter. The overflow valve is provided in the oil-way distribution block.

In order to achieve the above object, a flow configuration method of a lubrication system of the present invention includes following steps.

(1) Preparation for flow configuration of a lubricating pump: calibrating an engine oil pressure gage on a diesel engine, setting a minimum engine oil pressure alarm value: ≥0.05 MPa, providing a flexible overflow pipe with one end connected to an overflow port of an overflow valve and the other end led out of the diesel engine through an oil drain screw hole of an oil pan, putting in a measuring cup, sealing a gap between the oil drain screw hole of the oil pan and the overflow pipe, and filling oil into a lubricating oil tank with an oil quantity configured to be more than or equal to a sum of 1 liter and an oil quantity required for calculating longest theoretical turnover inversion time of a diesel engine test, which may be 6-7 liters.

(2) Engine oil pressure setting at a rated speed of a diesel engine: opening an oil inlet valve and an oil return valve, starting the diesel engine, making the speed of the diesel engine reach a rated speed, adjusting an overflow valve pressure adjusting screw to maintain the engine oil pressure of the diesel engine at 0.25-0.3 MPa, and locking the overflow valve pressure adjusting screw.

(3) Flow setting of the lubricating pump: maintaining the diesel engine in a rated working state, and adjusting the opening degree of the oil inlet valve to make the overflow port of the overflow valve maintain a continuous overflow rate of 1-2 L/min.

(4) Engine oil pressure verification of the diesel engine: fixing the diesel engine to a turnover frame in longitudinal and transverse directions respectively, idling the diesel engine according to Article 6.14.7 in the Revised Recommendation on Lifesaving Equipment Testing passed by the International Maritime Organization's Maritime Safety Committee MSC.81 (70), performing clockwise and counterclockwise turnover test to detect the engine oil pressure of the diesel engine during each test, and if there is an engine oil pressure alarm, increasing the opening degree of the oil inlet valve until there is no pressure alarm for the diesel engine during the whole process of the test.

(5) Provision of an engine oil cut-off pipe and determination of oil to be actually stored in an oil tank: providing a cut-off pipe connected between an outlet end of the oil inlet valve and a pipeline tip of an oil inlet of a lubricating pump according to the opening degree of the oil inlet valve, setting a small-hole area of the cut-off pipe to be equal to an opening area of the oil inlet valve, setting the cut-off pipe to have a diameter of Φ5 mm and a length of 12 mm, and determining oil to be actually stored in the lubricating oil tank according to a lowest oil level observed after turnover;

(6) Engine oil pressure re-verification of the diesel engine: opening the oil inlet valve and the oil return valve, and maintaining the engine oil pressure at 0.25-0.3 MPa under the rated speed of the diesel engine, wherein there is no engine oil pressure alarm in the case of idling, and otherwise, step (5) is repeated.

(7) Resetting: disassembling the oil pan, removing the overflow pipe, and resetting the oil pan.

The advantages and benefits of the present invention are as follows.

The present invention separates an engine oil collection function and an engine oil storage function borne by an oil pan of a lifeboat diesel engine. The oil pan bears the oil collection function. A lubricating oil tank is separately provided outside the machine for storing engine oil. When the diesel engine is working, a lubricating pump is used to convey, through a machine filter, engine oil in the lubricating oil tank to a main oil path of the diesel engine to lubricate the machine. An oil return pump is used to convey the engine oil collected in the oil pan after lubrication to the lubricating oil tank for storage. The engine oil of the diesel engine can be recycled. As an oil inlet valve of the lubricating pump passes the test, an accurate cut-off pipe diameter and an oil storage capacity actually required for the oil tank are obtained, which reduces the engine oil demand of the diesel engine when being inverted, and reduces the temperature rise caused by the overflow of the engine oil, thus making the product structure more scientific. The lubricating pump uses a flexible oil pipe in the lubricating oil tank to connect an oil suction port, so that the engine oil in the lubricating oil tank can be fully utilized.

The oil return pump of the present invention has a slightly larger flow than the lubricating pump, so that when the diesel engine is working, there is no oil in the oil pan. Therefore, no matter whether the diesel engine is turned over and inverted longitudinally or transversely, pollution caused by leakage of the engine oil spilling from the machine body is avoided.

In addition, since the lubricating oil tank is fixed outside the machine body of the diesel engine, a heat dissipation environment of the engine oil is improved, an engine oil cooler is omitted, and a lubricating oil tank level gage is provided to observe an oil level more conveniently. An oil drain valve is provided at the lower part of the lubricating oil tank, and the lubricating oil tank is overhead, so that it is more convenient for the diesel engine to change the engine oil. Through the pipeline, a gas collecting space in the upper left part of the lubricating oil tank is communicated with the crankcase, which not only avoids an outlet of the breathing one-way valve in the lubricating oil tank from being blocked by the engine oil when the lifeboat is fixed to the free-fall holder or falls freely, meets air pressure balance of the lubricating oil tank, but also avoids leakage of oil and gas to achieve environmentally-friendly drainage of the lubricating oil tank. By the provision of a safety valve on an oil filling port cover of the lubricating oil tank, the use safety of the lubricating oil tank is ensured.

In addition, a worm provided on a camshaft in the machine body is used to drive a worm gear on a pump shaft of a double engine oil pump to realize the power transmission of the engine oil pump, and the structure is more compact.

The advantages and features of the present invention are illustrated and explained by the following non-limiting description of the preferred embodiments, which are given by way of example only with reference to the drawings.

DESCRIPTION OF THE EMBODIMENTS

In order to make the objects and technical solutions of the present invention clearer, the present invention will be further described below in conjunction with the accompanying drawings and embodiments:

Those skilled in the art will appreciate that all terms (including technical and scientific terms) used herein have the same meaning as commonly understood by one of ordinary skill in the art to which the present invention belongs, unless otherwise defined.

"Left, right, up, down, front, and back" as used in the present invention mean that when a reader is facing the drawings, a left side of the reader is left, a right side of the reader is right, an upper side of the reader is up, a lower side of the reader is down, an inner surface of paper in front of the reader is front, and a surface facing the reader is back, rather than the specific limitation of the present invention.

The term "connection" as used in the present invention may be a direct connection between components or an indirect connection between components through other components.

Figure 1:
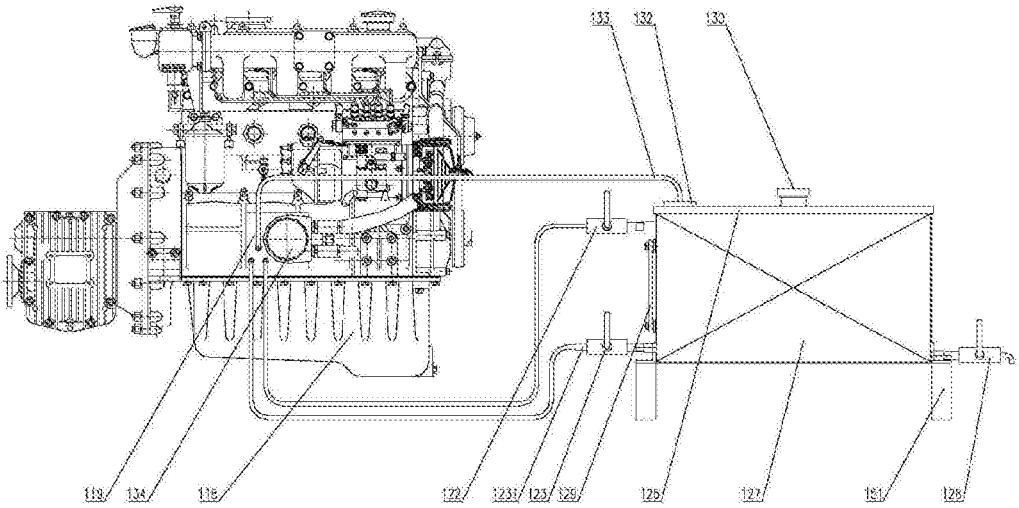
FIG. 1 is a schematic view of connection of a diesel engine and a lubricating oil tank thereof.
Figure 2:
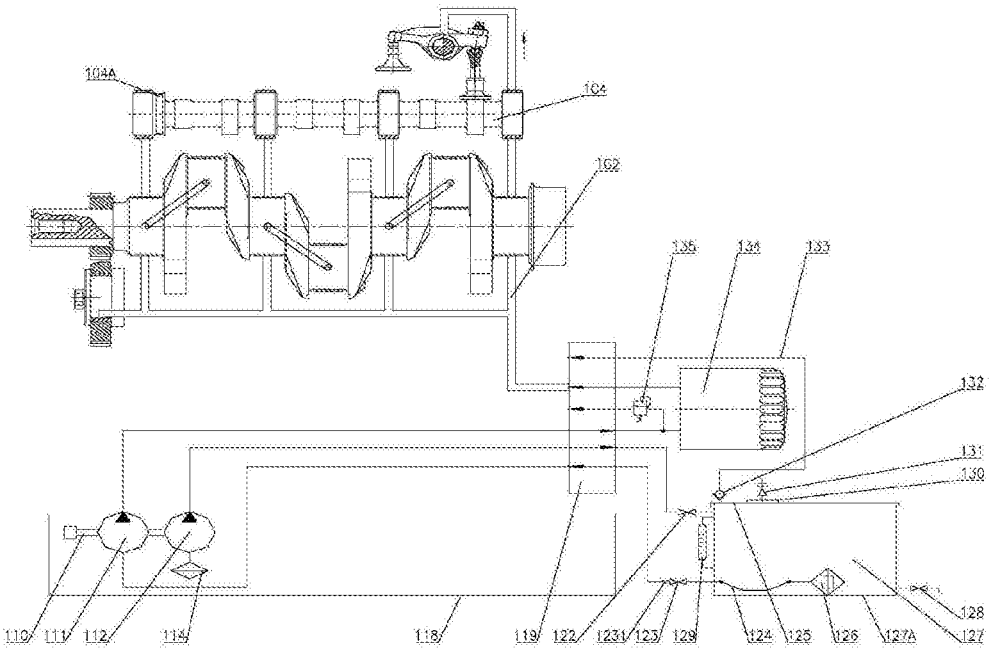
FIG. 2 is a schematic view of a lubrication system of the present invention.

As shown in FIG. 1 and FIG. 2, the lubricating oil tank 127 is a rectangular parallelepiped, and includes an oil tank body 127A and an oil tank cover 125. A sealing ring is further provided between the oil tank body and the oil tank cover. The capacity is about 8-9 liters. According to the test, it is necessary to store 6-7 liters of oil to ensure lubrication requirements when a diesel engine is turned over and inverted. The material is stainless steel. The lubricating oil tank 127 is fixed to a support 151 on the right side of the diesel engine. The support 151 is fixed to the bottom of a cabin. The support 151 has a height of 200-250 mm. An oil filling port 130 and a breathing one-way valve 132 are respectively provided on the oil tank cover 125. The breathing one-way valve 132 is provided in the left middle of the oil tank cover 125. An oil level indicator 129, an oil return valve 122 and an oil inlet valve 123 are vertically mounted on the left side surface of the oil tank body 127A, respectively. The oil level indicator 129 is provided with two oil level indicating sections at upper and lower ends. The oil level section at the upper end is a green mark, which is a diesel engine oil level mark when the lifeboat is upright. The oil level section at the lower end is a blue mark, which is a diesel engine oil level mark when the lifeboat is fixed to a free-fall holder. The oil level section at the lower end is a mapping section after the oil level section at the upper end inclines upwards from the left end of the lubricating oil tank 127 for 35°. An oil drain valve 128 is provided at the lower part of the right side of the oil tank body 127A for engine oil change. A flexible oil pipe 124 is connected to the right end of the oil inlet valve 123 inside the oil tank body 127A. A funnel-shaped oil suction port 126 having a magnetic adsorption function is connected to the other end of the flexible oil pipe 124. The opening of the oil suction port 126 can be always downward under the action of the gravity as the lubricating oil tank 127 is turned over and inverted, and the oil suction port 126 is maintained at the lower part of the engine oil in the lubricating oil tank 127, thereby ensuring the oil intake of the oil suction port 126 of the lubricating pump 111 when the diesel engine is turned over and inverted, and meeting the lubrication of the diesel engine.

The oil filling port 130 is provided with an oil filling port cover. An air pressure relief valve 131 is provided on the oil filling port cover. The air pressure relief valve 131 has a set pressure value of 1,150-1,200 kPa. When air pressure in the lubricating oil tank 127 reaches the value, the air pressure relief valve 131 is automatically opened to exhaust air. When the pressure value drops to 1,120-1,100 kPa, the air pressure relief valve 131 is automatically closed.

Figure 5:
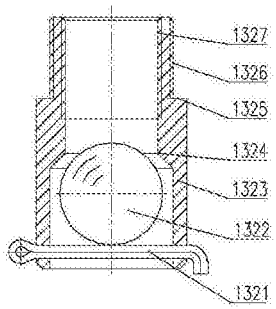
FIG. 5 is a schematic view of a breather one-way valve 132 of the present invention.

As shown in FIG. 5, the structure of the breathing one-way valve 132 includes a cylindrical casing 1323 with inner wall and outer wall that are both in shape of single step. An inner diameter and an outer diameter of the cylindrical casing are smaller at upper end than those at lower end. The lower inner of the cylindrical casing 1323 is provided with a steel ball 1322 having a diameter smaller than an inner diameter of the cylindrical casing where the steel ball located in by 2-3 mm. A boundary of the upper and lower inner of the cylindrical casing 1323 is provided with a circular valve 1324 which can be blocked by the steel ball 1322. The lower end of the casing 1323 is radially provided with a hole penetrating a split pin 1321. Through the blocking of the split pin 1321, the steel ball 1322 is always maintained in the lower inner of the casing 1323. The steel ball 1322 moves up and down within a distance of about 5-10 mm. By using an external thread 1326 and a step 1325 at the upper end of the casing 1323, the breathing one-way valve 132 is fixed to the left middle of the oil tank cover 125 through nuts. An internal thread 1327 is connected to one end of the breathing pipe 133. The other end of the breathing pipe 133 is connected to the crankcase. A breathing path of the lubricating oil tank 127 is: the breathing one-way valve 132—the breathing pipe 133—the oil-way distribution block 119—the crankcase in the machine body 101.

The function of the breathing one-way valve 132 is that when the lubricating oil tank 127 is inverted with the lifeboat, the steel ball 1322 blocks the valve 1324 under the action of gravity, and the one-way valve 132 is closed to prevent the engine oil in the lubricating oil tank 127 from flowing into the crankcase in the machine body 101. When the lubricating oil tank 127 is upright, the steel ball 1322 falls back to the lower end of the lower inner of the casing 1323.

Figure 3:
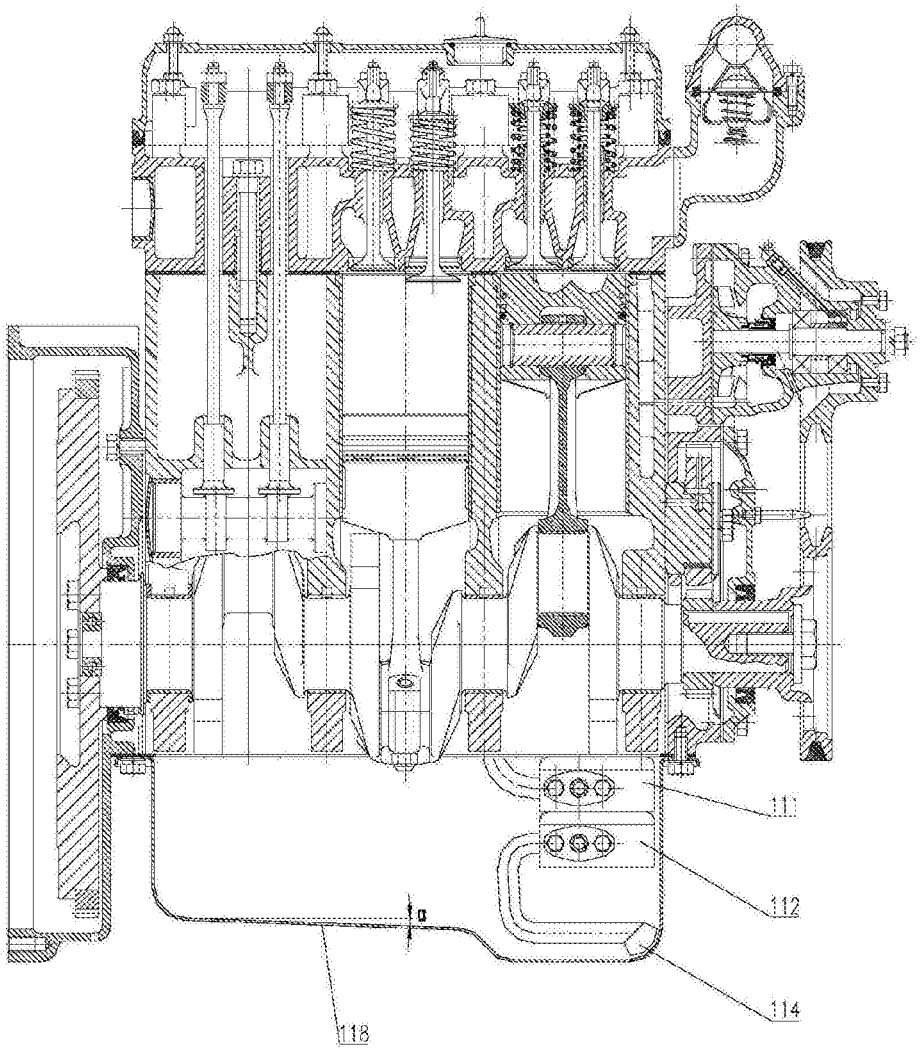
FIG. 3 is a schematic longitudinal sectional view of a diesel engine of the present invention.
Figure 4:
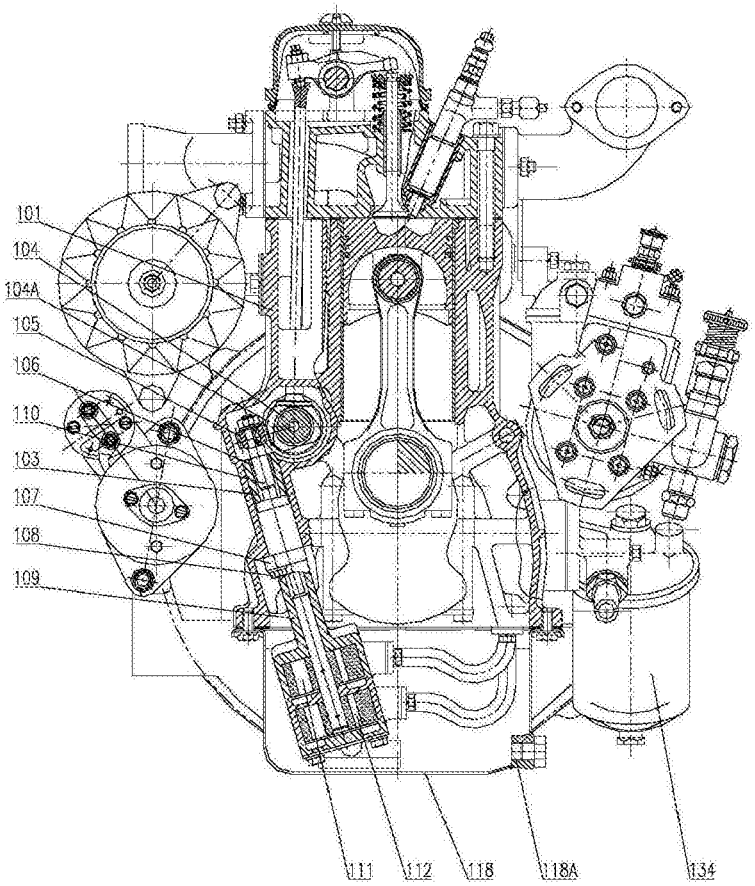
FIG. 4 is a schematic cross-sectional view of a diesel engine of the present invention.

As shown in FIG. 2, FIG. 3 and FIG. 4, the lower part of the machine body 101 is provided with an oil pan 118. In an axial direction of the diesel engine, the bottom of the oil pan 118 inclines from left to right at an inclination angle $\alpha$ of 2-3°, and an oil collection groove is provided in the bottom of the right side. An engine oil pump is provided on the right side in the oil pan 118. The engine oil pump is a double rotor pump having oil inlets and outlets independent separately, which is formed by superposing upper and lower layers, the upper layer being a lubricating pump 111 and a lower layer being an oil return pump 112. The lubricating pump 111 has a theoretical flow of 23-24 liters/min at a rated speed of the diesel engine of 2,800 rpm, and the oil return pump 112 has a theoretical flow greater than the flow of the lubricating pump 111 by 1-1.5 liters/min.

An oil return pump oil suction port 114 is provided on the lower right side of the oil collection groove of the oil pan 118, and has a strip shape. An oil outlet route of the oil return pump 112 is: the oil outlet end of the oil return pump 112—the oil-way distribution block 119—the oil return valve 122—the lubricating oil tank 127.

An oil inlet route of the lubricating pump 111 is: the oil suction port 126—the flexible oil pipe 124—the oil inlet valve 123—the cut-off pipe 1231—the oil-way distribution block 119—the oil inlet end of the lubricating pump 111. An oil outlet route of the lubricating pump 111 is: the oil outlet end of the lubricating pump 111—the oil-way distribution block 119—the machine filter 134—the oil-way distribution block 119—the main oil path 102. Before the engine oil enters the machine filter 134, an overflow valve 135 is provided inside the oil-way distribution block 119. The engine oil pressure of the main oil path 102 is controlled to be 0.25-0.3 Pa. The spilling oil of the overflow valve 135 flows back to the crankcase inside the diesel engine.

As shown in FIG. 4, the lubricating pump 111 and the oil return pump 112 share a pump shaft 110 and an oil pump casing 109. The pump shaft 110 passes through a positioning hole 103 provided in the machine body 101, and is positioned in a bearing 106. An upper end of the oil pump casing 109 is provided with a waist flange 107 fixed to the machine body 101 by a screw 108. An upper end of the pump shaft 110 is fixed with a worm gear 105 meshing with a worm 104A provided on a camshaft 104. The worm gear 105 has 13 teeth, and the worm 104A has 13 heads, that is, a transmission ratio of 1:1 and an end face modulus is 1.5. Therefore, the engine oil pump of the present invention transmits power through the camshaft 104, and the structure is more compact.

As shown in FIG. 1, FIG. 2 and FIG. 4, the flow configuration method of the lubrication system of the present embodiment includes the following steps.

(1) Preparation for flow configuration of a lubricating pump 111: Calibrate an engine oil pressure gage on a diesel engine to 0 position, set a minimum engine oil pressure alarm value: ≥0.05 MPa, select a flexible overflow pipe having an inner diameter of ®10, with one end connected to a pipe joint and to an overflow port of an oil-way distribution block 119 through the pipe joint, and with the other end led out of the diesel engine through an oil drain screw hole 118A of an oil pan 118, put in a measuring cup, block a gap of the oil drain screw hole 118A using softwood, and fill engine oil into a lubricating oil tank 127 with an oil quantity of 7 liters.

(2) Engine oil pressure setting at a rated speed of a diesel engine: Open an oil inlet valve 123 and an oil return valve 122, start the diesel engine, making the speed of the diesel engine reach a rated speed of 2,800 rpm, adjust a pressure adjusting screw of an overflow valve 135 to maintain the engine oil pressure of the diesel engine at 0.28-0.3 MPa, and lock the pressure adjusting screw of the overflow valve 135.

(3) Flow setting of the lubricating pump 111: Maintain the diesel engine at a rated speed, reduce the opening degree of the oil inlet valve 123 to 62% to make an overflow port of the overflow valve 135 maintain a continuous overflow rate of 1.8 L/min, and lock the opening degree of the oil inlet valve 123.

(4) Engine oil pressure verification of the diesel engine: Fix the diesel engine to a turnover frame in longitudinal and transverse directions respectively, idle the diesel engine according to Article 6.14.7 in the Revised Recommendation on Lifesaving Equipment Testing passed by the International Maritime Organization's Maritime Safety Committee MSC.81 (70), and perform clockwise and counterclockwise turnover test, where a diesel engine oil pressure change range during the test is 0.08-0.12 MPa, there is no alarm, and setting is met.

(5) Provision of an engine oil cut-off pipe 1231 and determination of oil to be actually stored in the lubricating oil tank 127: Provide a cut-off pipe connected between an outlet end of the oil inlet valve 123 and a pipeline tip of an oil inlet of the lubricating pump, where a pipe-hole area is equal to an opening area of the oil inlet valve, the pipe-hole diameter of the cut-off pipe is thus increased to about Φ5.0 mm, the pipe length is 12.0 mm, the remaining oil capacity is about 3.5 liters according to the observed lowest oil level after turnover, and it is determined that 6 liters of oil needs to be actually stored in the oil tank.

(6) Engine oil pressure re-verification of the diesel engine: Open the oil inlet valve and the oil return valve, and maintain the engine oil pressure at 0.25-0.3 MPa under a rated diesel engine speed of 2,800 rpm, where there is no engine oil pressure alarm in the case of idling.

(7) Resetting: Disassemble the oil pan, remove the overflow pipe, and reset the oil pan.

Other than the above embodiments, the present invention may have other implementations. Any technical solution formed by equivalent replacement or equivalent transformation falls within the protection scope of the present invention.

What is claimed is:

1. An inverted non-stop lifeboat diesel engine lubrication system, the lubrication system comprising an engine oil pump, an overflow valve, a machine filter, and a machine body, a crankcase being provided inside the machine body, and an oil pan being provided at a bottom of the machine body, wherein the lubrication system further comprises a lubricating oil tank and a breathing pipe; the lubricating oil tank is provided beside a gear chamber of a diesel engine, front and back surfaces of the lubricating oil tank are symmetric with a longitudinal vertical plane of a crankshaft axis of the diesel engine, and a support is provided at a bottom of the lubricating oil tank; the engine oil pump is a double pump having oil inlets and oil outlets independent separately, which is formed by superposing upper and lower layers, the upper layer being a lubricating pump and a lower layer being an oil return pump; an oil inlet of the oil return pump is connected to a bottom of a cavity of the oil pan through a pipeline, and an oil outlet of the oil return pump is connected to an interior of the lubricating oil tank through a pipeline; an oil inlet of the lubricating pump is connected to the interior of the lubricating oil tank through a pipeline, and the oil outlet of the lubricating pump is connected to an inlet of the machine filter through a pipeline; an inlet of the overflow valve is connected to a bypass between the oil outlet and the inlet of the machine filter; an outlet of the machine filter is communicated with a main oil path of the machine body; an outlet of the overflow valve is communicated with the crankcase; the lubricating oil tank comprises an oil tank cover and an oil tank body; the oil tank cover is provided with a breathing one-way valve and an oil filling port; an inlet of the breathing one-way valve is provided below the oil tank cover, and an outlet of the breathing one-way valve is provided above the oil tank cover; the outlet of the breathing one-way valve is communicated with one end of the breathing pipe, and the other end of the breathing pipe is communicated with the crankcase; the oil filling port is provided with an oil filling port cover, and the oil filling port cover is provided with an air pressure relief valve; an oil drain valve is provided at a bottom of the oil tank body, and an oil level indicator is provided on a side of the oil tank body.

2. The inverted non-stop lifeboat diesel engine lubrication system according to claim 1, wherein the engine oil pump is provided in the oil pan, an upper end of a pump shaft of the engine oil pump extends out of a pump body and penetrates though a bearing hole in the machine body, a worm gear is also provided at a top end of the pump shaft, and meshes with a worm provided on a camshaft of the diesel engine, and an upper end of the pump body of the engine oil pump is provided with a flange fixed to the machine body.

3. The inverted non-stop lifeboat diesel engine lubrication system according to claim 1, wherein the oil pan is a rectangular oil basin, the bottom of the basin inclines from left to right at an inclination angle $\alpha$ of 2-3°, and an oil collection groove is further provided in the bottom of a right end of the oil basin.

4. The inverted non-stop lifeboat diesel engine lubrication system according to claim 1, wherein the oil return pump comprises a funnel-shaped oil suction port with a filter screen, being provided on a lower right side of the oil collection groove, and a larger end of the funnel-shaped oil suction port faces the bottom of the oil collection groove.

5. The inverted non-stop lifeboat diesel engine lubrication system according to claim 1, wherein the lubricating pump is provided with a funnel-shaped oil suction port, a larger end of the funnel-shaped oil suction port is provided with a magnetic filter screen facing always downward, and a smaller end of the funnel-shaped oil suction port is connected to a suction port oil pipe end of an oil inlet valve on a side of the lubricating oil tank by a flexible oil pipe.

6. The inverted non-stop lifeboat diesel engine lubrication system according to claim 1, wherein the breathing one-way valve has a cylindrical casing with an inner wall and an outer wall that are both in shape of single step, an inner diameter and an outer diameter of the cylindrical casing are smaller at upper end than those at lower end, the upper end is an outlet of the breathing one-way valve, the lower end is an inlet of the breathing one-way valve, and both inner and outer of the upper end are provided with thread.

7. The inverted non-stop lifeboat diesel engine lubrication system according to claim 1, wherein an oil-way distribution block is provided between the machine body and the machine filter, and the overflow valve being provided in the oil-way distribution block.

8. The inverted non-stop lifeboat diesel engine lubrication system according to claim 3, wherein the oil return pump comprises a funnel-shaped oil suction port with a filter screen, being provided on a lower right side of the oil collection groove, and a larger end of the funnel-shaped oil suction port faces the bottom of the oil collection groove.

9. A method for configuring flow of an inverted non-stop lifeboat diesel engine lubrication system according to claim 1, the method comprising following steps:

(1) preparation for flow configuration of a lubricating pump: calibrating an engine oil pressure gage on a diesel engine, setting a minimum engine oil pressure alarm value: ≥0.05 MPa, providing a flexible overflow pipe with one end connected to an outlet of an overflow valve and the other end led out of the diesel engine through an oil drain screw hole of an oil pan, putting in a measuring cup, sealing a gap between the oil drain screw hole of the oil pan and the overflow pipe, and filling oil into a lubricating oil tank with an oil quantity configured to be more than or equal to a sum of 1 liter and an oil quantity required for calculating longest theoretical turnover inversion time of a diesel engine test;

(2) engine oil pressure setting at a rated speed of a diesel engine: opening an oil inlet valve and an oil return valve, starting the diesel engine, making a speed of the diesel engine reach the rated speed, adjusting an overflow valve pressure adjusting screw to maintain the engine oil pressure of the diesel engine at 0.25-0.3 MPa, and locking the overflow valve pressure adjusting screw;

(3) flow setting of the lubricating pump: maintaining the diesel engine in a rated working state, and adjusting an opening degree of the oil inlet valve to make the outlet of the overflow valve maintain a continuous overflow rate of 1-2 L/min;

(4) engine oil pressure verification of the diesel engine: fixing the diesel engine to a turnover frame in longitudinal and transverse directions respectively, idling the diesel engine according to Article 6.14.7 in the Revised Recommendation on Lifesaving Equipment Testing passed by the International Maritime Organization's Maritime Safety Committee MSC.81 (70), performing clockwise and counterclockwise turnover test to detect the engine oil pressure of the diesel engine during each test, and if there is an engine oil pressure alarm, increasing the opening degree of the oil inlet valve until there is no pressure alarm for the diesel engine during the whole process of the test;

(5) provision of an engine oil cut-off pipe and determination of oil to be actually stored in an oil tank: providing a cut-off pipe connected between an outlet end of the oil inlet valve and a pipeline tip of an oil inlet of the lubricating pump according to the opening degree of the oil inlet valve, setting a small-hole area of the cut-off pipe to be equal to an opening area of the oil inlet valve, setting the cut-off pipe to have a diameter of Φ 5 mm and a length of 12 mm, and determining oil to be actually stored in the lubricating oil tank according to a lowest oil level observed after turnover;

(6) engine oil pressure re-verification of the diesel engine: opening the oil inlet valve and the oil return valve, and maintaining the engine oil pressure at 0.25-0.3 MPa under the rated speed of the diesel engine, wherein there is no engine oil pressure alarm in a case of idling, and otherwise, repeating step (5); and (7) resetting: disassembling the oil pan, removing the overflow pipe, and resetting the oil pan.

* * * * *